United States Patent [19]

Spiess

[11] Patent Number: 4,735,241

[45] Date of Patent: Apr. 5, 1988

[54] BAG-FILLING MACHINE

[75] Inventor: Joachim Spiess, Hanover, Fed. Rep. of Germany

[73] Assignee: Natronag Gesellschaft fuer Verpackungssysteme mbH, Goslar, Fed. Rep. of Germany

[21] Appl. No.: 931,189

[22] Filed: Nov. 17, 1986

[30] Foreign Application Priority Data

Nov. 15, 1985 [DE] Fed. Rep. of Germany ..... 3540505

[51] Int. Cl.[4] ..... B65B 1/04

[52] U.S. Cl. ..... 141/68; 141/83; 141/286; 141/315; 222/195; 406/90

[58] Field of Search ..... 141/10, 67, 68, 114, 141/313–317, 285–310, 4–7, 83; 222/195, 637; 406/88, 89, 90

[56] References Cited

U.S. PATENT DOCUMENTS 2,359,029 9/1944 Goldberg ..... 141/67

3,219,072 11/1965 Lau ..... 141/67

*Primary Examiner*—Houston S. Bell, Jr.

*Attorney, Agent, or Firm*—Schwartz, Jeffery, Schwaab, Mack, Blumenthal & Evans

[57] ABSTRACT

A bag-filling machine, in which the material to be filled is conveyed by compressed air through a filling tube, has a storage cylinder which is closed at its underside by a grid-like floor having ventilation apertures. The filling tube is fitted above the floor in the peripheral wall of the storage cylinder. An improvement in the flow of the material to be filled and a more complete emptying on termination of the filling procedure are achieved if the floor is formed from at least three segments. Below the segments, sealed relative to one another, respective specifically associated compressed air supply chambers are disposed which are each provided with a regulatable compressed air supply.

14 Claims, 5 Drawing Sheets

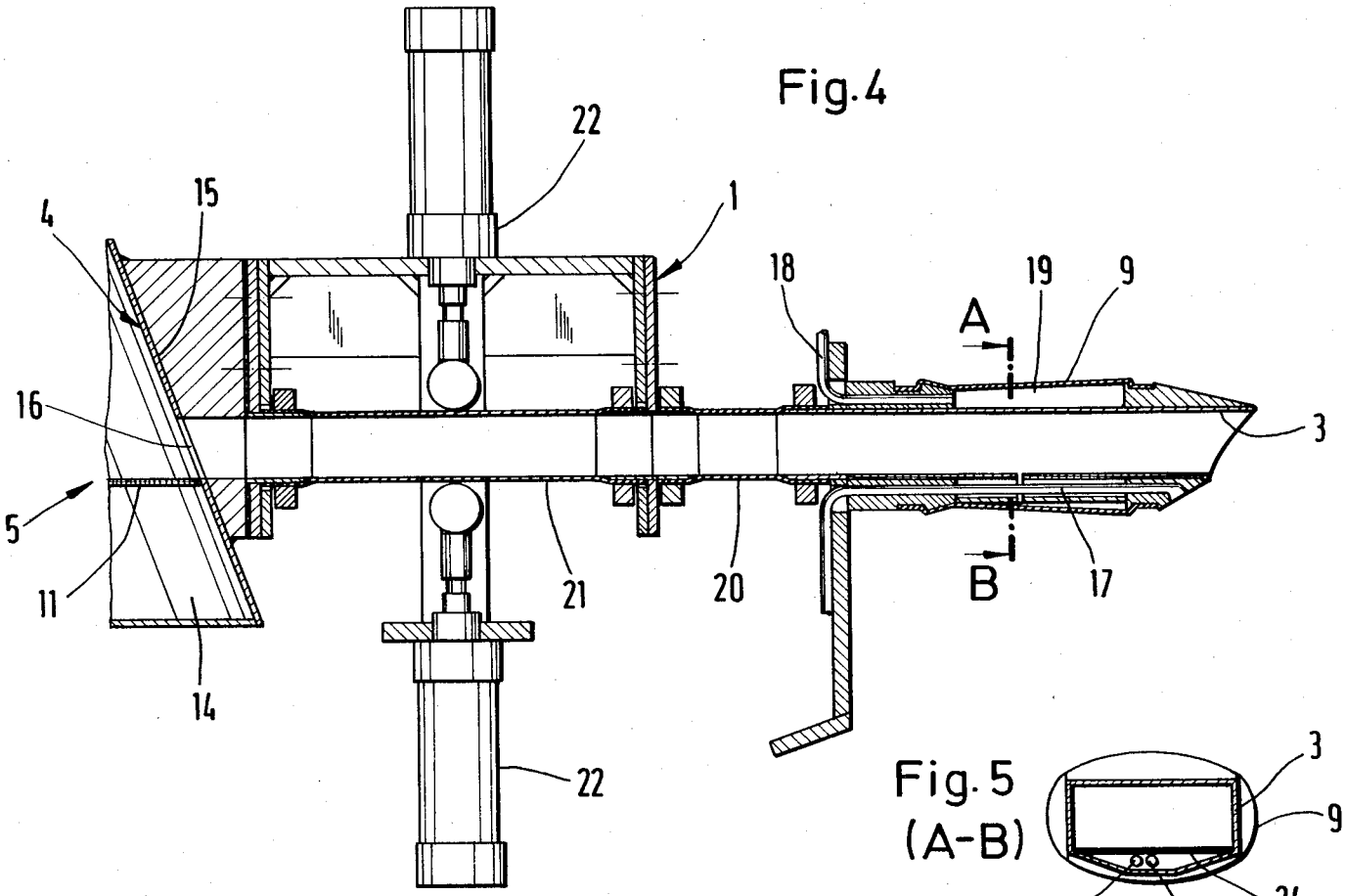
Fig.4
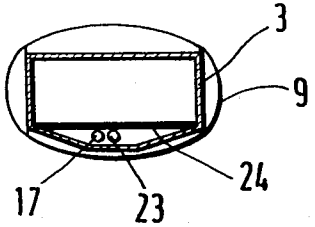
Fig.5 (A-B)

BAG-FILLING MACHINE

BACKGROUND OF THE INVENTION

The invention relates to a bag-filling machine in which the material to be filled is conveyed by compressed air through a filling tube. The bag-filling machine has a storage cylinder which is closed at its underside by a grid-like floor having ventilation apertures. The filling tube is fitted in the peripheral wall of the storage cylinder, above the floor.

Bag-filling machines of such a type, which operate by the pneumatic conveying principle, have been known for many years and are used for the filling of bags with dust-forming goods. The grid-like floor serves to loosen up the material to be filled by means of the air stream so that the material becomes flowable and can pass into the filling tube. It is known to construct the floor so as to be inclined downwardly relative to the filling tube in order to assure more favorable flow conditions at the transition from the storage cylinder to the filling tube. Furthermore, it is known to broaden the filling tube, which is disposed at a certain spacing above the floor, conically towards the storage cylinder so that a nozzle-like transition from the storage cylinder to the filling tube is produced.

In practice, pneumatic conveying per se has become established. Disadvantages are such that the filling tube is not completely emptied when the bag, which is controlled by a weighing machine, is filled. As a rule, the filling tube is also included in the weighing because the bag is suspended at the filling tube and cannot be weighed independently of the filling tube. This problem leads to an inaccuracy in the weighing process. This inaccuracy brings about a situation in which, by way of a precautionary measure, more material must be filled into the bag than intended. Problems also arise when changing the material to be filled, since very large residual quantities remain in the conventional type filling machines. These residual quantities must be emptied, whereby the change-over time is considerably increased.

SUMMARY OF THE INVENTION

It is therefore an object of the present invention to provide a bag-filling machine which assures a substantially improved flow of the pneumatically conveyed material to be filled and leads at least to a reduction of the residual filling quantity contained in the filling tube and in the storage cylinder.

It is also an object of the present invention to provide a bag-filling machine that eliminates the dead angle at the storage cylinder wall disposed opposite to the filling tube.

It is a further object of the present invention to provide a bag-filling machine in which the storage cylinder floor is constructed from a plurality of segments.

Another object of the present invention is to provide a bag-filling machine in which the bag can be weighed independently of the filling tube.

It is still another object of the invention to provide a bag-filling machine that reduces the change-over time from one type of fill material to another.

In accordance with one aspect of the present invention, these objects are achieved by a bag-filling machine in which the floor is formed from at least three segments, below which, sealed relative to one another, respective specifically associated compressed air supply chambers are disposed, which are each provided with a regulatable compressed air supply.

In accordance with another aspect of the present invention, these objects are achieved by a bag-filling machine for use with material which is made flowable by compressed air, which comprises, a storage cylinder having a grid-like floor and a peripheral wall, the floor comprising at least three segments, each segment having ventilation apertures, a filling tube disposed in the peripheral wall above the grid-like floor, and an individually sealed compressed air supply chamber connected to and disposed below each of the at least three segments, each compressed air supply chamber being provided with a regulatable compressed air supply.

In accordance with a further aspect of the present invention, these objects are achieved by a bag-filling machine further comprising compression means for reducing the effective cross-section of a portion of the filling tube.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is explained in greater detail below, with reference to illustrative embodiments shown in the drawings, in which:

FIG. 4 shows a vertical section through the filling tube and the transition region between storage cylinder and filling tube, FIG. 5 shows a section along the line AB in FIG. 4.

DETAILED DESCRIPTION OF THE PREFERRED EMBODIMENTS

Figure 1:
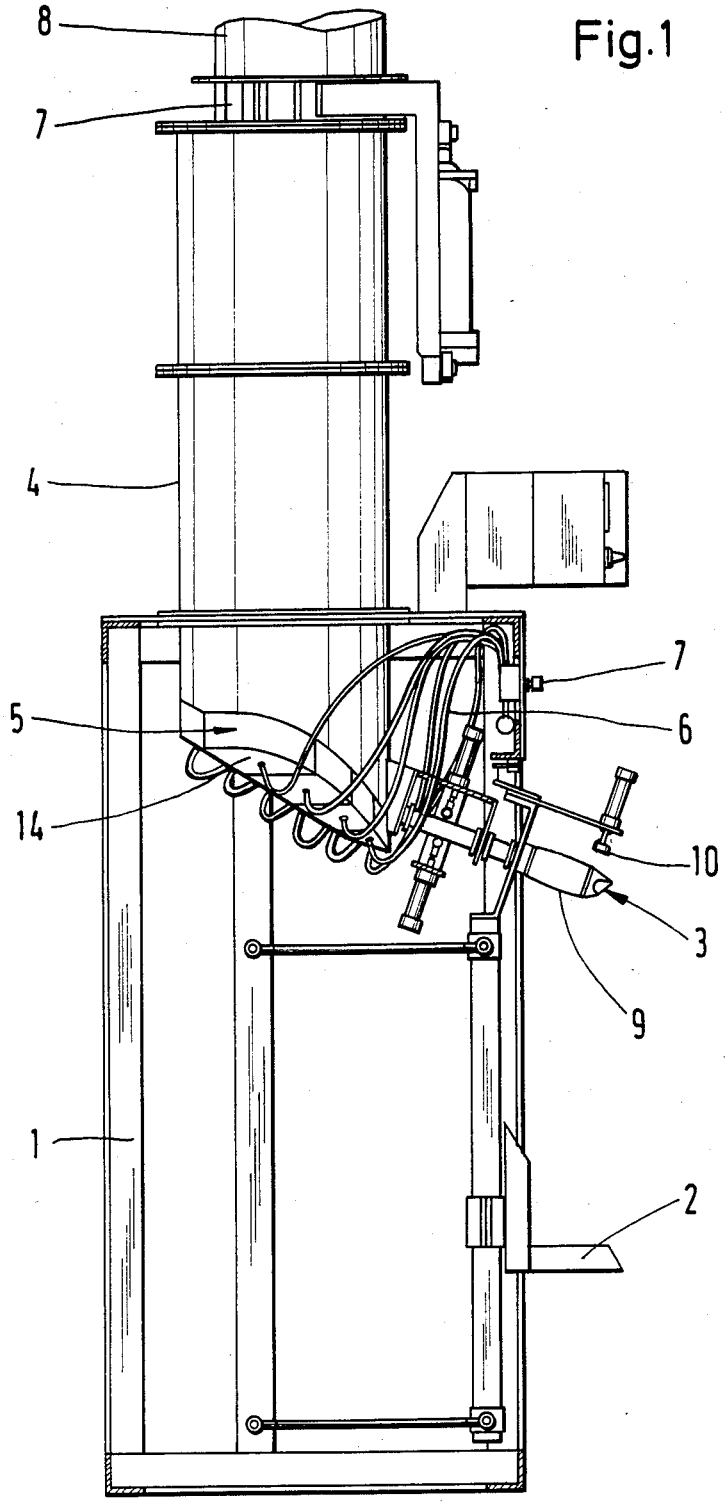
FIG. 1 shows a side elevation of a filling machine according to the invention.

Intensive investigations have shown that by the construction of the floor from a plurality of segments the fluidization and flow of the filling material from the storage cylinder to the filling tube can be substantially improved. In the case of the conventional one-part floor a considerable dead angle arises at the storage cylinder wall disposed opposite to the filling tube. This dead angle, which is practically not encompassed by the flow of material to be filled, can be substantially reduced or even entirely avoided if the floor is divided into segments provided with specifically associated compressed air supplies and the pressure for the individual segments is set in a suitable manner. The setting of the pressure for the various segments, including the relative setting of the pressure of the segments among one another, is dependent upon the respective material to be filled. The optimal setting may readily be determined experimentally, without further invention, by a person skilled in the art.

In a desired embodiment, at least four segments are disposed one behind the other in a line between the filling tube and the storage cylinder wall disposed opposite the filling tube. A result which is optimal in practice is achieved if the floor in this arrangement is inclined downwardly and the angle of inclination is between about 10° and about 45° relative to the horizontal, preferably approximately 20°. The flow pattern becomes particularly favorable if the segment which is disposed directly in front of the filling tube has approximately the width of the filling tube and the width of the segments disposed one behind the other increases conically with increasing distances from the filling tube.

An alternative embodiment, requiring additional expenditure, may be achieved if the segments disposed one behind the other are continued laterally by lateral segments. In this arrangement, the lateral segments should be inclined obliquely to the central segments disposed one behind the other. A groove running conically to the filling tube is created, which is formed from the central segments disposed one behind the other and the lateral segment. It is also possible for the lateral segments to be subdivided into a plurality of lateral segments disposed one behind the other or beside one another.

In the case of the filling machine according to the present invention, it is advantageous if the underside of the filling tube is disposed in alignment with the upper side of the floor. This leads to the avoidance of a step at the transition between floor and filling tube, such as was present in the case of the conventional filling machines.

Furthermore, unexpected results are obtained if the filling tube is connected to a passage aperture in the wall of the storage cylinder and the aperture cross-section of which is substantially identical to the cross-section of the filling tube. It has surprisingly been shown that any nozzle-like construction of the transition from the storage cylinder to the filling tube leads to a deteriorated flow.

A particularly good emptying of the filling tube is obtained if the filling tube cross-section has a width substantially greater than the height. If this connection, the ratio of width to height preferably amounts to approximately 2:1. Preferably, the filling tube width is greatest at its floor, and is therefore, for example, semicircular or preferably rectangular.

The emptying of the filling tube is also promoted in that the filling tube is disposed so as to be downwardly inclined. In this connection, the inclination of the filling tube can, preferably, correspond approximately to the inclination of the floor in the line between the filling tube and the storage cylinder wall disposed opposite the filling tube.

A complete emptying of the filling tube and of the storage cylinder is achieved if the floor and the filling tube are inclined downwardly by 45° relative to the horizontal. This downward inclination of the filling tube causes considerable problems in the filling of valve bags with internally disposed valves. A compromise, which in practice is very effective, is achieved if the storage cylinder floor and filling tube are inclined downwardly by approximately 20° relative to the horizontal.

The filling machine shown in FIG. 1 has a supporting frame 1 at which a bag support 2 is secured as part of a weighing arrangement. To the arrangement movable with the bag support there is connected a filling tube 3, which opens into a storage cylinder 4 held at the frame 1. The storage cylinder is closed at its lower end by an obliquely set floor 5. FIG. 1 shows, at the underside of the floor 5, a plurality of compressed air ducts 6, by which compressed air is conducted to various positions of the floor 5 which is subdivided into several regions. At the upper end of the storage cylinder 4 there is situated a blocking device 7, which separates the storage cylinder 4 from a supply duct 8 leading to a storage silo (not shown) for the material to be filled.

The filling tube 3 is surrounded at its front end, on which a valve of a valve bag is fitted, by an expansion pipe 9, which assures a seal between filling tube 3 and the valve of the valve bag, so that blowing-out of the dust-forming material to be filled is prevented. The bag fitted to the filling tube 3 is fixed in a known manner on the filling tube 3 by means of a pneumatically controlled plunger 10 pressing onto the filling tube from above. The air pressure supplied via the compressed air ducts 6 is adjustable by means of setting regulators 7; in this connection, depending upon the particular case of application, a specifically associated setting regulator 7 can be provided for each compressed air duct 6, or a setting regulator 7 can be provided for a sub-group of compressed air ducts 6 as well.

Figure 2:
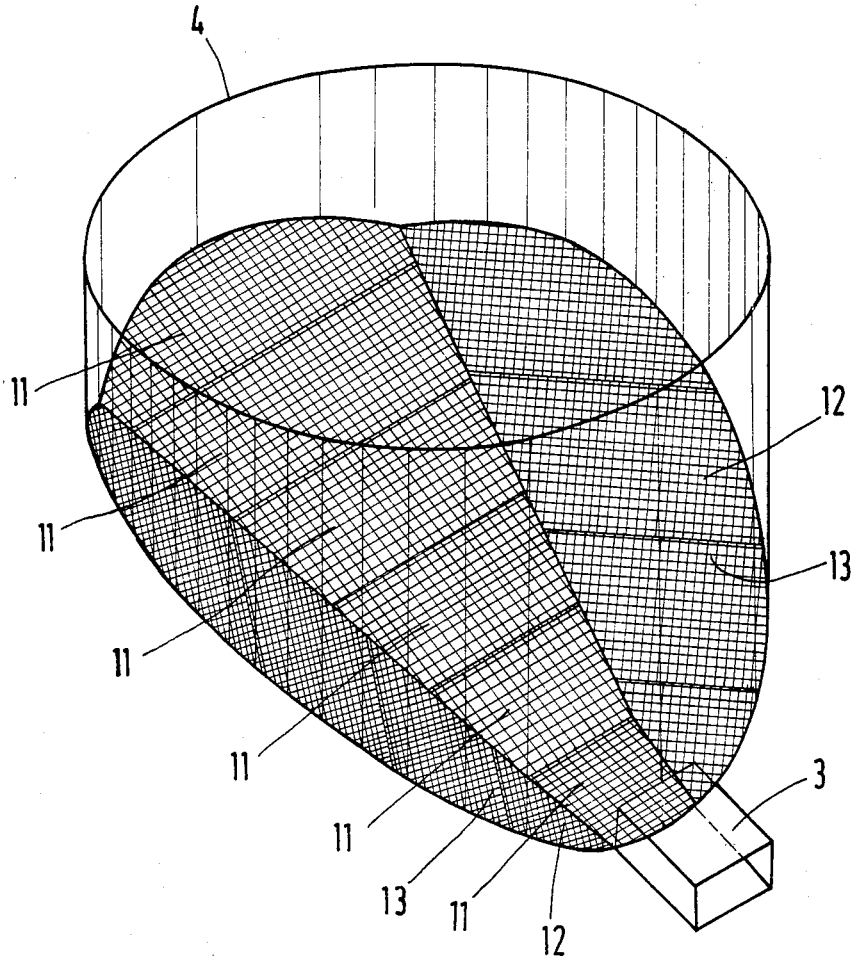
FIG. 2 shows a perspective view of an obliquely disposed floor of the storage cylinder with central segments and lateral segments.

FIG. 2 shows schematically that the filling tube 3 in a preferred embodiment has a rectangular cross-section. From the filling tube to the opposite wall of the storage cylinder 4 there are provided six segments, which are disposed one behind the other and of which the first segment 11, which is adjacent the filling tube 3, has at the place of transition to the filling tube 3, the width of the filling tube 3. All segments 11 become broader conically towards the wall, disposed opposite the filling tube of the storage cylinder 4, so that they form a conically proceeding path towards the filling tube 3. The segments 11 adjoin one another and are downwardly inclined towards the filling tube 3, relative to the horizontal. In a preferred embodiment, the first segment adjacent the filling tube 3 has a smaller inclination than the remaining segments 11, which are all equally inclined and uniformly adjoin one another. The inclination of the segment 11 adjacent the filling tube 3 is adapted to the inclination of the filling tube 3, as is illustrated by FIG. 3*b*.

The segments 11 disposed one behind the other are supplemented laterally by lateral segments 12 to form the complete floor 5. The lateral segments 12 adjoining on both sides of the segments 11 are inclined laterally to the segments 11 disposed one behind the other. On each side of the segments 11 there are provided four lateral segments, the separation lines 13 of which stand approximately perpendicular to the direction pointing to the filling tube 3 from the lateral segments 12. The segments 11 disposed one behind the other form, together with the laterally ascending lateral segment 12, a groove, which is approximately U-shaped in cross-section and the turned-up limbs of which diverge obliquely upwards.

Figure 3C:
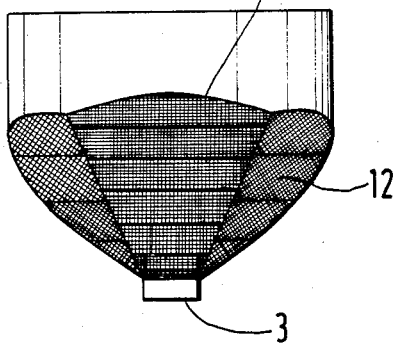
FIG. 3*c* shows a side elevation from the direction of the filling tube of the floor.
Figure 3B:
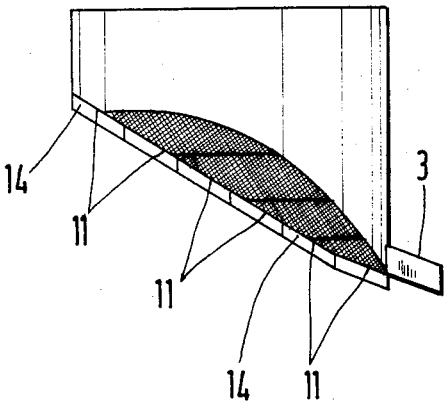
FIG. 3*b* shows a side elevation of the floor.
Figure 3A:
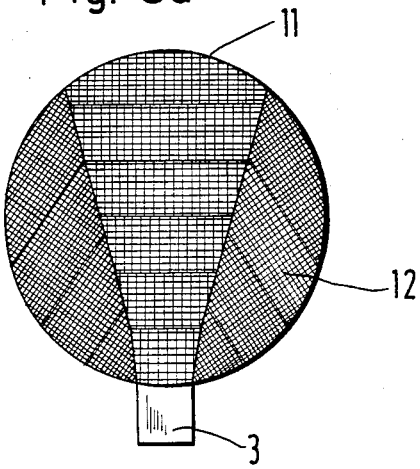
FIG. 3*a* shows a plan view of the floor from above.

Each of the segments 11, 12 has at its underside a pressure chamber 14 as shown in FIGS. 1 and 3*b*. The pressure chambers 14 are sealed relative to one another and have in each instance a specifically associated compressed air supply duct 6. In this manner, it is assured that the air flowing through the grid-segments 11, 12 of the floor 5 is regulatable for each segment 11, 12 relative to other segments 11, 12. Expediently, the compressed air supply 6 for each segment 11, 12 will be provided with a specifically associated setting regulator 7.

The appropriate setting of the setting regulators 7 for each segment 11, 12 permits an adaptation to the respective material to be filled. Depending upon the weight and particle size of the material to be filled, various setting combinations can lead to an optimal fluidization and thus to an optimal flow of the material to be filled through the storage cylinder 4 and the filling tube 3.

Figure 6:
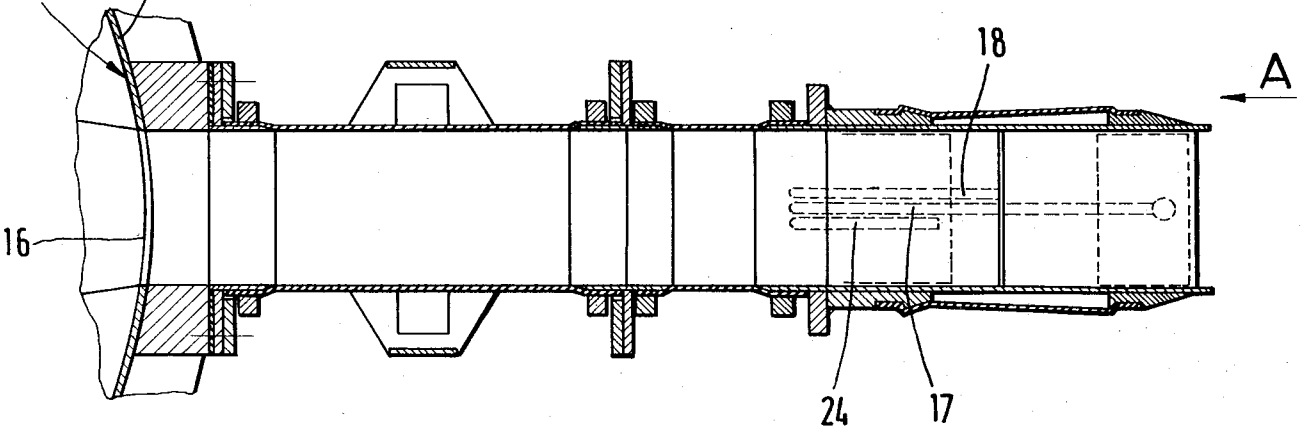
FIG. 6 shows a horizontal section through the arrangement shown in FIG. 4.

The two sectional views in FIG. 4 and FIG. 6 illustrate the construction of the rectangular filling tube 3 as well as the transition of the filling tube 3 into the storage cylinder 4.

In the region of the lower part, the storage cylinder 4 has a wall 15 in which there is situated a passage aperture 16, which is in alignment with the cross-section of the filling tube 3. The floor of the filling tube 3 is in alignment with the upper side of the pertinent floor segment 11, so that on the underside of the filling tube 3 a uniform transition between floor 5 and the underside of the filling tube 3 exists. Moreover, the passage aperture 16 opposite the wall 15 of the storage cylinder 4 leads to sharp-edged transitions. Accordingly, a nozzle-like broadening for the production of a gradual transition has been avoided.

FIGS. 4 through 6 further show an air exhaust duct 17 at the underside of the filling tube 3 below the rectangular cross-section, as well as a compressed air supply duct 18 at the under side of the filling tube, which opens into a chamber 19 surrounded by the expansion pipe 9 and thus causes the expansion of the expansion pipe 9.

For the weight decoupling of the front part of the filling tube 3, the latter is continued towards the frame 1 by a soft rubber piece 20. Within the frame, there adjoins a further rubber piece 21, which is compressible my means of two pressure pistons 22, in order to reduce the effective cross-section of the filling tube by approximately three quarters for the remainder of the filling process, in which there is a fine flow of material. The rubber pieces 20, 21 have the same internal cross-section as the filling tube 3.

Beside the air exhaust duct 17 there is further disposed a compressed air supply duct 23, which ends below a filling tube floor part constructed as a screen 24 with two ventilation segments, thus creating at the floor a fluidized bed for the complete emptying of the residue.

What is claimed is:

1. A bag-filling machine for use with material which is made flowable by compressed air, comprising:

(a) a storage cylinder having a grid-like floor and a peripheral wall, said floor being downwardly inclined and comprising at least three segments, each segment having ventilation apertures;

(b) a downwardly inclined filling tube disposed in said peripheral wall above said grid-like floor and communicating with said grid-like floor along a transition, the inclination of said filling tube adjacent said transition corresponding to the inclination of the segment of said grid-like floor adjacent said transition, and (c) an individually sealed compressed air supply chamber connected to and disposed below each of said at least three segments, each compressed air supply chamber being provided with a regulatable compressed air supply.

2. The bag-filling machine as claimed in claim 1, wherein said grid-like floor further comprises at least four segments which are disposed one behind the other.

3. The bag-filling machine as claimed in claim 2, wherein said floor is downwardly inclined towards said filling tube approximately 20° relative to the horizontal.

4. The bag-filling machine as claimed in claim 3, wherein the width of the segment disposed at the transition to said filling tube is approximately the same size as the width of said filling tube, and wherein the width of the segments disposed one behind the other increases conically with increasing distance from said filling tube.

5. The bag-filling machine as claimed in claim 4, wherein said segments disposed one behind the other are continued laterally by lateral segments.

6. The bag-filling machine as claimed in claim 5, wherein said lateral segments are inclined obliquely to said segments disposed one behind the other.

7. The bag-filling machine as claimed in claim 6, wherein said underside of said filling tube is disposed in alignment with the upper side of said grid-like floor.

8. The bag-filling machine as claimed in claim 7, wherein said filling tube is connected to a passage aperture of said peripheral wall of said storage cylinder, the aperture cross-section of which is substantially identical with said cross-section of said filling tube.

9. The bag-filling machine as claimed in claim 8, wherein said filling tube cross-section width is substantially greater than said filling tube cross-section height.

10. The bag-filling machine as claimed in claim 9, wherein said filling tube width is greatest as said filling tube floor.

11. The bag-filling machine as claimed in claim 10, wherein said filling tube has a rectangular cross-section.

12. The bag-filling machine as claimed in claim 11, wherein said filling tube floor further comprises at least in part a screen, below which a compressed air duct ends.

13. The bag-filling machine as claimed in claim 1, further comprising compression means for reducing the effective cross-section of a portion of said filling tube.

14. The bag-filling machine as claimed in claim 1 wherein the segment of said grid-like floor adjacent said transition is downwardly inclined at a lesser angle than the other segments of said grid-like floor.

* * * * *